US006293548B1

(12) United States Patent
Swyers et al.

(10) Patent No.: US 6,293,548 B1
(45) Date of Patent: Sep. 25, 2001

(54) METHOD AND SYSTEM FOR CONDUCTING RACES

(76) Inventors: John Swyers, 167 Lawndale Rd., Mansfield, MA (US) 02048; Patrick F. McGinnis, 6147 LaGoleta Rd., Goleta, CA (US) 93117

( * ) Notice: Subject to any disclaimer, the term of this patent is extended or adjusted under 35 U.S.C. 154(b) by 0 days.

(21) Appl. No.: 09/542,043

(22) Filed: Mar. 31, 2000

(51) Int. Cl.[7] ..... A63F 9/14
(52) U.S. Cl. ..... 273/236; 273/246; 273/445
(58) Field of Search ..... 273/236, 246, 273/248, 258, 277, 445

(56) References Cited

U.S. PATENT DOCUMENTS

| | | | | |
|---|---|---|---|---|
| 3,690,666 | | 9/1972 | Seitz . | |
| 3,795,907 | | 3/1974 | Edwards . | |
| 4,264,076 | | 4/1981 | Duncan . | |
| 5,048,841 | | 9/1991 | Manney et al. . | |
| 5,092,605 | * | 3/1992 | Hoffman | 273/246 |
| 5,139,267 | * | 8/1992 | Trevisan | 273/246 |
| 5,186,460 | | 2/1993 | Fongeallaz et al. . | |
| 5,322,293 | * | 6/1994 | Goyette | 273/246 |
| 5,398,941 | | 3/1995 | Paulson . | |
| 5,934,673 | | 8/1999 | Telarico et al. . | |

* cited by examiner

*Primary Examiner*—Benjamin H. Layno
(74) *Attorney, Agent, or Firm*—Lambert & Associates, PLLC; Gary E. Lambert; Edward Timmer

(57) ABSTRACT

A method of conducting a racing competition among a plurality of racers comprising the steps of conducting qualifying races among the plurality of racers; awarding qualifying (Q) credits based on a predetermined formula and the results of each of the plurality of racers' qualifying races; arranging the racers in a reverse-qualifying order arrangement for the start of the race and assigning passing (P) credit values to the plurality of racers based on a predetermined formula and the racer's position in the reverse-qualifying starting order arrangement. The race is then started with the plurality of racers arranged in the reverse-qualifying order arrangement, the plurality of the racers are then awarded P credits during the course of the race based on a predetermined formula and the other racers each of the plurality of racers passes. At the finish of the race, the finish time and position of each of the plurality of racers is determined. Finishing (F) credits are then awarded to the plurality of racers finishing the race based a predetermined formula and the finish time and position of each of the plurality of racers. The race winner and order of finish is determined based on a predetermined formula and the amount of Q, P and F credits awarded to each of the plurality of racers.

15 Claims, 1 Drawing Sheet

METHOD AND SYSTEM FOR CONDUCTING RACES

BACKGROUND OF THE INVENTION

The present invention relates to racing events. In particular, the present invention pertains to a novel method of conducting a race that encourages improved racing and thus improved race fan excitement.

People have conducted races for centuries. People are, as if by nature, competitive. As such, people are interested in knowing which person, horse, camel, vehicle, tractor, beetle, or etc. is the fastest. Races have therefore been organized and conducted to determine exactly which person, camel, beetle or etc. is the fastest. Although races have long been conducted, the format of races has changed very little over the centuries. Races are still generally conducted by having the race participants simultaneously start at a common starting time and then travel over a race course a predetermined fixed distance. The first race participant to cover the required race course distance is traditionally declared the winner and thus the fastest.

While determining the fastest competitor in a given race, the traditional and conventional method of conducting races as described above does not always make for the most interesting and captivating race for fans observing the race. Races all too often evolve into a contest where a majority of the contestants chase the front-runner(s). In particular, automotive races oftentimes degenerate into an exhibition of "follow the leader" where the fastest cars, qualifying and starting at the front of the grid, maintain their positions at the front of the race throughout the majority of the race. The race in effect becomes a "follow the leader" event since the cars with the fastest times during qualifying trials begin the race at the forefront of those participating in the race.

Some of the most exciting racing action occurs when cars pass other cars. This is even more exciting when a fast car or driver qualifies for a starting position in the middle or back of the starting grid. This situation most often occurs due to technical, procedural or driver miscalculations during the qualifying trial(s). When this situation does occur, race fans are often treated to some of the most captivating racing since the faster, skilled driver often boldly and aggressively passes other cars in route to the front of the pack. The racing fans are thus treated to a creative display of driving skill and strategy as the misplaced fast car attempts to advance to the front of the pack and challenge the other fast cars.

A racing method is needed that will encourage top speeds, competitive and creative driving and continued competitiveness among the race participants throughout the entirety of the race.

SUMMARY OF THE INVENTION

The present invention results from the realization that a more exciting race is effectuated by conducting a race that encourages and rewards the race participants for fast qualifying times, skillful passing and fast finishing times. The present inventive race method for conducting a race comprises conducting qualifying races, rewarding the racers for fast qualifying times, organizing the race participants in a reverse-qualifying time arrangement for the start of the race, rewarding racers for competitive passing of other racers during the race, rewarding racers for fast finishes and determining a race winner based on a combination of factors related to qualifying time, passes made and finishing time. The race method of the present invention provides incentives for the racers to qualify fast and to race competitively and to finish the race in a fast time. Since racers participating in a race conducted according to the present invention start the race in reverse-qualifying order and are rewarded for more than finishing the race fast, it is in the racers best self-interest to compete at their highest level throughout all phases of the race. The result is a competitive race that is challenging for the drivers yet more uncertain in outcome for the fans than traditionally conducted races.

The present invention comprising a reverse-qualifying order start and awarding of credits—either points or time credits—for passing encourages increased passing attempts to occur. Prior to conducting a race however, the form of credits that will be awarded during the race, either points or time credits, is decided. All race participants are equally challenged in the race since the racers in front of them qualified at a slower qualifying time.

Racers participating in a race conducted according to the present invention may be awarded with credits, either points or time credits, based on 1) the time/order of qualifying, 2) competitive passing during the race and 3) the time/order of finishing the race. The overall winner of a particular race may be determined based on a combination of the points and/or time credits awarded for a particular race. The specifics concerning the amount of points/credits awarded, number of racers eligible for points/credits and the formula by which the various points/credits are combined to determine a winner may vary depending on the race format or the preferences of the race organizers. According to the present racing method there may be more than one winner since the race participant finishing first in time, i.e. the traditional winner, may not necessarily finish first in terms of the number of point/time credits accumulated during the race. Additionally, this racing method contemplates determining a championship winner based on the cumulative point/time credits of racers over series of individual races.

The aforementioned specifics however are typically predetermined prior to the start of a race so that the race participants can strategically plan and execute the race. Accordingly, the present invention may be adapted to reward qualifying, competitive passing and finishing in numerous arrangements and formats.

The race method of the present invention may be adapted for any number of race formats, venues and/or racing entities, including but not limited to real-world, computer-based race simulation games or virtual reality game formats. The invention will be disclosed herein below and throughout primarily in the context of motor racing. The motor racing context will be used throughout for reasons of clarity and consistency, not as a limitation in any manner. The invention itself is not limited to motor racing or any other particular type or form of racing. As will be realized, the invention is capable of other and different embodiments than those described herein without departing from the scope of the invention.

PREFERRED EMBODIMENT OF THE INVENTION

Figure 1:
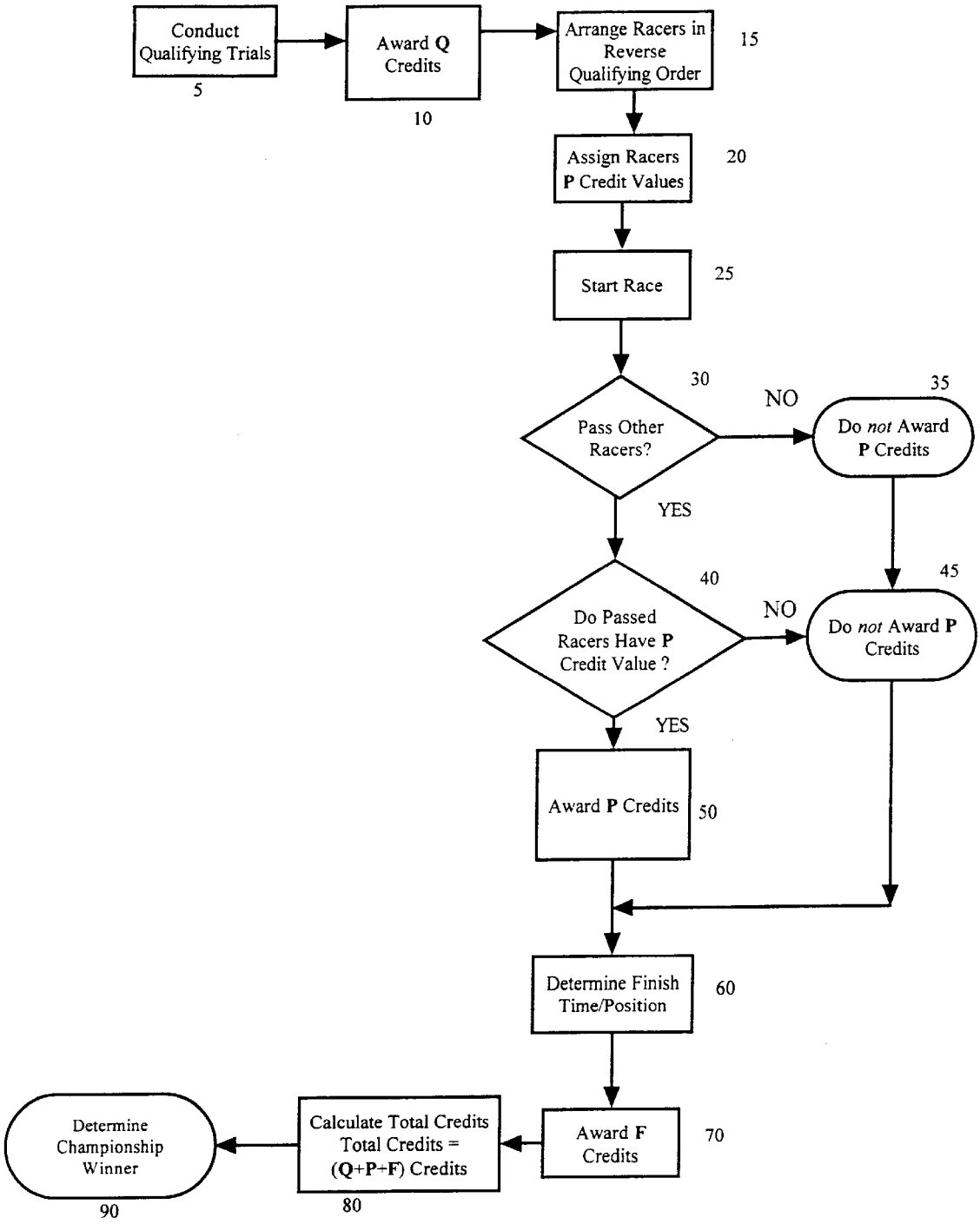
FIG. 1 is an overall flow diagram depicting the typical sequence of events of a race conducted according to a preferred embodiment of the race method encompassing the present invention.

Referring to FIG. 1, a flowchart of the present invention, the general steps of the race method encompassing the present invention are depicted. As shown, the present inventive method begins with a qualification stage 5 during which qualifying trials(s) are conducted. The race participants typically individually race against a clock to determine each race participant's maximum speed or minimum time to complete the qualifying trial on the racecourse. The race participants are often permitted to attempt multiple qualifying races in order to maximize their qualifying speeds. The qualifying stage 5 may comprise the race participants racing against other race participants and/or a clock. The specific format of the qualifying stage 5 however may vary depending on the preferences, traditions, etc. of the race organizers.

The race participants are then ranked based on their qualifying times with the faster qualifying racers being ranked higher than the slower qualifying racers. Qualifying, Q, credits are then awarded 10 based on the racers qualifying times and ranks. In a preferred embodiment, only a limited number of the top qualifying racers are awarded Q credits. The amount of credits potentially available for qualifying times is usually predetermined before the qualifying races are conducted in order to fairly inform the racers of the stakes of the qualifying stage 5 trials.

The awarding of Q credits 10 provides an incentive for the race participants to qualify with fast times. The amount of points awarded should normally be carefully considered in order to provide enough incentive for the racers to compete for fast qualifying times yet not so plentiful, in either amount or weight, so as to diminish the value of credits awarded during other stages of a race conducted according to the present racing method.

Still referring to FIG. 1, the racers are arranged 15 in a reverse-qualifying order. That is, the slowest qualifying car is positioned in the first starting grid location. The starting grid layout is also usually predetermined and is established by the race organizers on the basis of safety concerns, personal preferences and tradition. Therefore, the slowest qualifying racer will start in the row 1, lane 1 position, i.e. the "pole" position. The second slowest car is then positioned in row 1, lane 2 to start the race. This reverse-qualifying order arranging process continues until all of the starting positions are filled or until all cars have been placed in the starting grid in reverse-qualifying order. At the completion of step 15, the slower qualifying racers will be positioned in front of the faster qualifying racers. This starting setup is the opposite of the customary start in traditionally conducted races.

With reference to table 1 below, a typical preferred Q point award schedule is shown in column 2 detailing the amount and distribution of Q points awarded in a race that awards and totals point credits as a basis for determining the individual race winner. As shown in table 1, column 2 the first fastest six qualifying racers are awarded Q point credits for their top qualifying speeds/times.

TABLE 1

Q Credit Award Schedule (Typ.)

| Qualifying Position | Q Point Credits | Q Time Credits (secs) |
|---|---|---|
| 1st | 10 | 45 |
| 2nd | 6 | 30 |
| 3rd | 4 | 20 |
| 4th | 3 | 15 |
| 5th | 2 | 10 |
| 6th | 1 | 5 |
| nth | 0 | 0 |

Alternatively, table 1, column 3 above depicts a typical preferred award schedule detailing the amount and distribution of Q time credits awarded in a race that awards and totals time credits to determine the race winner. In table 1 only the top six qualifying racers are awarded Q credits. The seventh through $n^{th}$ qualifiers are not awarded Q credits. The Q time credits will be subtracted from the racer's finishing time.

After the racers are arranged in reverse-qualifying order 15, the racers are then assigned passing or P credit values 20. The P credit values are assigned based on the racer's starting position in the starting grid. The P credit values are assigned and awarded based on a predetermined formula and criteria. In a preferred embodiment, only a certain number of race participants are assigned P credit values. Refer to table 2 for a typical preferred P point credit value assignment schedule. Refer to table 2 also for a typical preferred P time credit value assignment schedule. According to table 2 therefore, if car 5 is passed, the passing car is awarded 3 P points or (−3 seconds) P time credits.

TABLE 2

P Credit Award Schedule

| Qualifying Position | P Point Credit Value | P Time Credit Value (sec) |
|---|---|---|
| 1 | 3 | 5 |
| 2 | 3 | 5 |
| 3 | 3 | 5 |
| 4 | 3 | 5 |
| 5 | 3 | 5 |
| 6 | 3 | 5 |
| 7 | 2 | 3 |
| 8 | 2 | 3 |
| 9 | 2 | 3 |
| 10 | 2 | 3 |
| 11 | 2 | 3 |
| 12 | 2 | 3 |
| 13 | 2 | 3 |
| 14 | 2 | 3 |
| 15 | 0 | 0 |
| 16 | 0 | 0 |
| 17 | 0 | 0 |
| 18 | 0 | 0 |
| 19 | 0 | 0 |
| 20 | 0 | 0 |
| 21 | 0 | 0 |
| 22 | 0 | 0 |
| 23 | 0 | 0 |

The next step after the race participants are arranged in reverse qualifying order 15 and assigned P credit values 20 is to start the race 25. The race may be started in the usual fashion per the organizers and/or sanctioning body rules, regulations and traditions.

After the start of the race 25, the race participants begin to actively compete, pass and plan how to finish the in first position. The act of passing is encouraged and in fact rewarded in a race conducted according to the present invention since P credits are awarded to racers that pass other racers having P credit values assigned thereto. Passing is also facilitated under the present race format since the faster qualifying racers start the race behind the slower qualifying and perhaps less skilled racers. The P credits are awarded based on a predetermined formula or criteria.

In a preferred embodiment, competitive passes, i.e. passing cars having an assigned P credit value, are assessed throughout the race. Race officials can award P credits, points/time credits, as each racer completes a competitive pass. For purposes of clarity of explanation and as an example only, an illustrative example of a race will be explained wherein the passing status of the race participants in a sixty lap race will be evaluated at the 15, 30, 45 and 60 lap intervals of the race.

FIG. 1 shows that after the start of the race 25, a determination is made whether the racers have passed other racers at step 30. If the particular racer has not passed any other racers then P credits are not awarded to that driver, steps 35 and 45. If the particular racer has passed other racers then the determination is made whether that racer made competitive passes by passing other racers having P credit values, step 40. This determination is made since competitive passing is rewarded. If the other racers passed have P credit values, then P credits are awarded 50 to the racer making the competitive pass(es). The awarding of P credits continues throughout the duration of the race until the finish of the race at lap 60, step 60. At the end of the race, finish or F credits are awarded based on the order of finish. In a preferred embodiment, only the top six finishers are awarded F credits. Please refer to table 3 below for a F credit award schedule. The table 3 lists the F point credits and time credits available in a preferred embodiment of the current racing method.

TABLE 3

F CREDIT AWARD SCHEDULE

| Finishing Position | 1st | 2nd | 3rd | 4th | 5th | 6th | 7th | nth |
|---|---|---|---|---|---|---|---|---|
| F Point Credits | 10 | 6 | 4 | 3 | 2 | 1 | 0 | 0 |
| Q Time Credits (sec) | 45 | 30 | 20 | 15 | 10 | 5 | 0 | 0 |

At the conclusion of the race 60 and awarding of F credits 70, an overall winner for the individual race is determined based on a predetermined formula that takes into account the total Q credits, P credits and F credits awarded to each race participant, step 80. In a preferred embodiment, the combined total of points/time credits awarded to each racer is tallied together to calculate a total point value for each racer. The racer having the greatest number of total points or fastest time after factoring in the awarded point and/or time credits is declared the individual race winner. The formula used to determine the winner of the race may vary depending on the preferences of the race organizers sanctioning bodies, etc. It is contemplated that the formula or criteria used to determine the race winner will in most instances, at least in part, depend on the amount of Q, P, and F credits awarded to the race participants during the race.

The racing fan's interest can be enhanced over an entire racing season by further providing for the awarding and recognition of a championship winner by linking the individual races together under an overall championship system. Based on a predetermined format, the credits—points/time credits that individual racers earn in individual races can be accumulated to determine a racing championship winner 90.

A specific example of the above-disclosed race method will now be described below. The following example is not meant to limit the present invention in any manner and is included for purposes of clarity and by way of example only. In the following example race, the race comprises sixty laps. There is a qualifying stage. Refer to the tables 1, 2 and 3 for the schedule of Q credits, P credits and F credits (point/time credits) in the following example.

For clarity and simplicity reasons, the evaluation of P credits in the following example is only shown at the fifteen, thirty, forty-five and sixty(finish) lap intervals of the sixty lap race. Table 4 below should be referenced to at all times during the following example race discussion. The table 4 details the qualifying positions of the 23 race cars in the race in column 1. The following race example awards Q, P and F credits. For purposes of clarity and simplicity, the qualifying position of each race car corresponds to the race car identification number. Therefore, car number 1 qualifies first, and so on.

Column 2 of table 4 shows the reverse-qualifying order starting position for the 23 racers starting the race. Columns 3, 4, 5 and 6 show each car's position at the end of lap 15,30,45 and 60.

In most races numerous cars do not finish. For clarity and simplicity in this example, the even numbered cars do not finish the race, i.e., they retire.

The tabular method of recording and listing the relative positions of the race competitors at the start, certain other intervals of the race and at the finish of the race is a concise and useful method of presenting the events of the race. Each of the racer's position, from the qualifying trials thru the race finish, is included in the tabular listing. In addition to each racer's position at the start and finish of the race, the racer's position is listed for other intervals of the race. In the example shown in table 4, three race intervals are included. The specific number of intervals included in the tabular listing may be varied.

The tabular listing provides a concise race summarization for race fans following a race. The tabular listing depicted in table 4 enables a race fan to follow their favorite racer throughout the race as the race progresses or to evaluate the race at a later time. By listing the qualifying position of a given racer at the far left of the table and the position of the given racer at subsequent time intervals of the race progressively to the right of the qualifying position, the race can be evaluated in a time progression manner as the race progresses.

Table 4 may be further modified to include the speeds or race times of the racers. For purposes of clarity however, this feature is not depicted in the table 4 included below.

TABLE 4

Race Summary

| Qualifying Position | Start | Lap 15 | Lap 30 | Lap 45 | Lap 60 (Finish) |
|---|---|---|---|---|---|
| 1 | 23 | 13 | 10 | 11 | 3 |
| 2 | 22 | 12 | 13 | 4 | 5 |
| 3 | 21 | 10 | 11 | 3 | 1 |
| 4 | 20 | 11 | 15 | 5 | 11 |
| 5 | 19 | 16 | 7 | 7 | 7 |
| 6 | 18 | 15 | 4 | 2 | 13 |
| 7 | 17 | 21 | 5 | 1 | 9 |
| 8 | 16 | 17 | 8 | 13 | 15 |
| 9 | 15 | 23 | 3 | 9 | 19 |
| 10 | 14 | 19 | 9 | 15 | 21 |
| 11 | 13 | 4 | 19 | 19 | 17 |

TABLE 4-continued

| Qualifying Position | Start | Lap 15 | Lap 30 | Lap 45 | Lap 60 (Finish) |
|---|---|---|---|---|---|
| | | Race Summary | | | |
| 12 | 12 | 7 | 21 | 21 | 23 |
| 13 | 14 | 8 | 17 | 17 | 2 |
| 14 | 10 | 9 | 23 | 23 | 4 |
| 15 | 9 | 6 | 2 | 10 | |
| 16 | & | 5 | 1 | 8 | |
| 17 | 7 | 3 | 16 | | |
| 18 | 6 | 2 | 6 | | |
| 19 | 5 | 1 | 12 | | |
| 20 | 4 | 20 | | | |
| 21 | 3 | 14 | | | |
| 22 | 2 | 22 | | | |
| 23 | 1 | 18 | | | |

After the awarding of Q credits and the assignment of P credits values, the race is started. The racers compete to gain the lead during the race. At the fifteen lap interval of the race, four cars, numbers 20, 14, 22 and 18, have retired. That is, four cars were unable to complete at least fifteen laps of the race. The "Lap 15" column of table 4 shows the order of the racers after the fifteen lap interval. Refer to table 5 below for a detailed showing of the P credits awarded during the fifteen lap interval. As shown in table 4, a number of racers have passed other racers between the first and fifteenth lap of the race. Table 5 details the racers that passed other racers and the P credits (points/time credits) awarded to the passing racers based on the P values assigned to the passed racers. Note, in general either points or time credits are awarded for a given race.

TABLE 5

| Car # | Competitively Passed | P CREDITS Point Credited | P CREDITS Time Credited (secs) |
|---|---|---|---|
| | Lap 15 | | |
| 13 | 14 | 2 | −3 |
| 10 | 11 | 2 | −3 |
| 4 | 5 − 6 − 7 − 8 − 9 | 3 + 3 + 2 + 2 + 2 = 12 | −5 − 5 − 3 − 3 − 3 − 3 = −19 |
| 7 | 8 − 9 | 2 + 2 = 4 | −3 − 3 = −6 |
| 8 | 9 | 2 | −3 |
| 11 | 16 − 15 − 21 − 17 − 19 . . . | 0 | 0 |

➤Cars Retired: 22; 20; 14; 18

At the thirty lap interval of the race, three more racers have retired, namely the number 16, 6 and 12 racers. Of the remaining racers, the racers numbered 10, 7, 5, 3 and 4 competitively passed other racers between the sixteenth and thirtieth laps. Table 6 details the P credits awarded to the racers that made passes during this lap interval.

TABLE 6

| Lap 30 Car # | Competitively Passed | P CREDITS Points Credited | P CREDITS Time Credited (sec) |
|---|---|---|---|
| 10 | 13 | 2 | −3 |
| 8 | 9 | 2 | −3 |
| 5 | 8 − 9 | 2 + 2 = 4 | −3 −3 = −6 |
| 3 | 9 | 2 | −3 |
| 4 | 19 − 17 − 21 | 0 + 0 + 0 | 0 |

➤ Cars Retired: 16; 6; 12

At the forty-five lap interval of the race, two more racers have retired, namely the number 10 and 8 racers. Of the remaining racers, the racers numbered 11, 4, 3, 5, 7, 2 and 1 competitively passed other cars at the forty-five lap interval. Table 7 details the P credit awarded to the racers that made passes at the forty-five lap interval.

TABLE 7

| Car # | Competitively Passed | P CREDITS Point Credited | P CREDITS Time Credited (secs) |
|---|---|---|---|
| | Lap 45 | | |
| 11 | 13 | 2 | −3 |
| 4 | 7 − 13 − 15 | 2 + 2 = 4 | −3 − 3 = −6 |
| 3 | 5 − 7 − 15 | 3 + 2 + 2 = 7 | −5 − 3 − 3 = −11 |
| 5 | 7 − 13 | 2 + 2 = 4 | −3 − 3 = −6 |
| 7 | 13 | 2 | −3 |
| 2 | 23 − 17 − 21 − 19 − 15 − 13 − 9 | 0 + 0 + 0 + 0 + 0 + 2 + 2 = 4 | −3 − 3 = −6 |
| 1 | 23 − 17 − 21 − 19 − 15 − 13 − 9 | 0 + 0 + 0 + 0 + 0 + 2 + 2 = 4 | −3 − 3 = −6 |

➤Cars Retired: 10; 8

At the sixty lap interval or finish of the race, two more racers have retired, namely the number 2 and 4 racers. Of the remaining racers, the racers numbered 3, 5 and 1 passed other cars at the sixty lap interval. Table 8 details the P credits awarded to the racers that made passes at the sixty interval.

TABLE 8

| Lap 30 (Finish) Car # | Competitively Passed | P CREDITS Points Credited | P CREDITS Time Credited (sec) |
|---|---|---|---|
| 3 | 11 | 2 | −3 |
| 5 | 11 | 2 | −3 |
| 1 | 7 − 11 | 2 + 2 = 4 | −3 −3 = −6 |

➤ Cars Retired: 2; 4

Since car #3 crossed the finish line first, the driver can be recognized as the traditional winner. However, an overall race winner may be recognized after all of the credits awarded during the race are evaluated. A detailed examination of the sum of all awarded credits will allow the effect of the claimed invention to be clearly understood. in the following tables 9 and 10 below.

TABLE 9

Final Scoring: Point Credit Method

| Finish Position | Car # | Qualifying Position | Q Point Credits | P Point Credits | F Point Credits | Total Points | Overall Place |
|---|---|---|---|---|---|---|---|
| 1st | 3 | 3 | 4 | 0 + 2 + 7 + 2 | 10 | 25 | WINNER |
| 2nd | 5 | 5 | 2 | 0 + 4 + 4 + 2 | 8 | 20 | 3rd |
| 3rd | 1 | 1 | 10 | 0 + 0 + 4 + 3 | 6 | 24 | 2nd |
| 4th | 11 | 11 | 0 | 0 + 0 + 2 + 0 | 4 | 6 | 5th |
| 5th | 7 | 7 | 0 | 4 + 0 + 2 + 0 | 2 | 8 | 4th |
| 6th | 13 | 13 | 0 | 2 | 1 | 3 | 6th |
| 7th | 9 | 9 | 0 | 0 | 0 | 0 | 7th |
| 8th | 15 | 15 | 0 | 0 | 0 | 0 | 8th |
| nth | | | | | | 0 | nth |

Alternatively, the race could be scored and evaluated on the basis of awarding Q, P and F time credits instead of Q, P and F points. The tables 5–8 also list the corresponding time credits possible under a time credit based scoring race. The table 10 below details the total time credits awarded and the resulting totals based upon the above example race. Please note that in the example detailed here and summarized in table 10 below that F time credits are not awarded to the racers finishing the race. Each individual racer's finishing time is reduced by an amount of time equal to the Q and P time credits awarded to the individual racers. In other contemplated embodiments encompassing the present racing method, the race participants may be awarded F time credits.

TABLE 10

Final Scoring: Time Credits Method

| Finish Position | Car # | Qualifying Position | Q Credit Time (sec) | P Credit Time (sec) | Race Finish Time | Total Time | Overall Place |
|---|---|---|---|---|---|---|---|
| 1st | 3 | 3 | −20 | 0 − 3 − 11 − 3 | 1:42:26 | 1:41:49 | 2nd |
| 2nd | 5 | 5 | −10 | 0 − 6 − 6 − 3 | 1:42:41 | 1:42:16 | 3rd |
| 3rd | 1 | 1 | −45 | 0 − 0 − 6 − 6 | 1:42:44 | 1:41:47 | 1st |
| 4th | 11 | 11 | 0 | 0 − 0 − 3 − 0 | 1:42:58 | 1:42:55 | 5th |
| 5th | 7 | 7 | 0 | −6 − 0 − 3 − 0 | 1:43:01 | 1:42:52 | 4th |
| 6th | 13 | 13 | 0 | −3 − 0 − 0 − 0 | 1:43:07 | 1:43:04 | 6th |
| 7th | 9 | 9 | 0 | 0 | 1:43:42 | Same | 7th |
| 8th | 15 | 15 | 0 | 0 | 1:43:50 | Same | 8th |

As such, the method of conducting a racing competition detailed above constitutes the inventor's preferred embodiment and alternate embodiments to the invention. While the invention has been described and illustrated with reference to specific embodiments, it is understood that these and other embodiments may be resorted to without departing from the invention. Therefore, the form of the invention set out above should be considered illustrative and not as limiting the scope of the following claims.

What is claimed is:

1. A method of conducting a racing competition among a plurality of racers comprising the steps of:

conducting qualifying trials among the plurality of racers;

awarding Q credits to the plurality of racers based on a predetermined formula and the results of each of the plurality of racers' qualifying trials;

arranging the racers in a reverse-qualifying order arrangement for the start of the race;

assigning P credit values to a predetermined number of the plurality of racers based on a predetermined formula and the racer's position in the reverse-qualifying starting order arrangement;

starting the race with the plurality of racers arranged in the reverse-qualifying order arrangement;

awarding P credits to the plurality of racers during the course of the race based on a predetermined formula and the other racers each of the plurality of racers passes during the race;

determining the finish time and position of each of the plurality of racers at the conclusion of the race;

awarding F credits to the plurality of racers finishing the race based a predetermined formula;

determining the winner and order of the race finish based on a predetermined formula and the amount of Q credits, P credits and F credits awarded to each of the plurality of racers.

2. The racing method of claim 1 wherein the qualifying trials comprises a plurality of trial races for each of the plurality of racers.

3. The racing method of claim 1 wherein the plurality of racers having faster qualifying trials are awarded a greater or equal amount of Q credits than the plurality of racers having slower qualifying trial.

4. The racing method of claim 1 wherein the plurality of racers having faster qualifying trials are assigned a P credit value of greater or equal value than the plurality of racers having slower qualifying trials.

5. The racing method of claim 1 wherein the race is started with the plurality of racers in a stationary position.

6. The racing method of claim 1 wherein the race is started with the plurality of racers in a non-stationary position.

7. The racing method of claim 1 wherein the plurality of racers are awarded P credits for passing other of the plurality of racers having assigned P credit values greater than zero.

8. The racing method of claim 1 wherein the awarding of P credits is done at predetermined intervals of the race.

9. The racing method of claim 1 wherein the plurality of racers having faster finishing race times are awarded a greater or equal amount of F credits than the plurality of racers having slower finishing race times.

10. The racing method of claim 1 wherein the winner and order of the race finish is determined by a predetermined formula based, at least in part, on the amount of Q, P and F credits awarded to each of the plurality of racers during the race.

11. The racing method of claim 10 wherein the winner and order of the race finish is determined by summing each of the plurality of racers' Q credits, P credits and F credits awarded for the race.

12. The racing method of claim 1 further comprising determining a championship winner based on a predetermined formula which, at least in part, on the amount of Q credits, P credits and F credits awarded to a racer in a plurality of races.

13. The racing method of claim 1 further comprising determining a championship winner based on a predetermined formula which, at least in part, combines the total Q credits, P credits and F credits awarded to a racer in a plurality of races.

14. The racing method of claim 1 wherein the Q credits, P credits and F credits awarded to the plurality of racers corresponds to time credits.

15. The racing method of claim 1 wherein the Q credits, P credits and F credits awarded to the plurality of racers corresponds to point credits.

* * * * *